US007240727B2

(12) United States Patent
Williams

(10) Patent No.: US 7,240,727 B2
(45) Date of Patent: Jul. 10, 2007

(54) ARMORED STRIPPER RUBBER

(76) Inventor: John R. Williams, 4500 Williams Dr. #212-404, Georgetown, TX (US) 78628

( * ) Notice: Subject to any disclaimer, the term of this patent is extended or adjusted under 35 U.S.C. 154(b) by 344 days.

(21) Appl. No.: 10/845,786

(22) Filed: May 12, 2004

(65) Prior Publication Data

US 2005/0183856 A1 Aug. 25, 2005

Related U.S. Application Data

(63) Continuation-in-part of application No. 10/783,450, filed on Feb. 20, 2004.

(51) Int. Cl.
*E21B 33/03* (2006.01)
*E21B 33/068* (2006.01)

(52) U.S. Cl. ..... 166/84.3; 166/84.1; 277/324; 277/343

(58) Field of Classification Search ..... 166/387, 166/84.1, 84.3; 277/324–326, 343, 344; 175/84

See application file for complete search history.

(56) References Cited

U.S. PATENT DOCUMENTS 2,578,056 A * 12/1951 French ..... 251/1.3
2,583,497 A * 1/1952 Schweitzer ..... 277/343
2,762,638 A * 9/1956 Brown ..... 277/343
3,029,083 A * 4/1962 Wilde ..... 277/343
3,152,809 A * 10/1964 Waldrop ..... 277/335
3,268,233 A * 8/1966 Brown ..... 277/343
4,098,516 A * 7/1978 Murman ..... 277/327
4,143,880 A * 3/1979 Bunting et al. ..... 277/322
4,154,448 A * 5/1979 Biffle ..... 277/326
4,254,962 A * 3/1981 Blackwell ..... 277/335
4,441,551 A * 4/1984 Biffle ..... 166/84.3
4,447,037 A * 5/1984 Huey et al. ..... 251/1.2
4,531,580 A * 7/1985 Jones ..... 166/84.3
5,062,479 A * 11/1991 Bailey et al. ..... 166/84.3
5,305,839 A * 4/1994 Kalsi et al. ..... 175/162
5,647,444 A * 7/1997 Williams ..... 175/209
5,901,964 A * 5/1999 Williams et al. ..... 277/326
6,016,880 A * 1/2000 Hall et al. ..... 175/195
6,109,348 A * 8/2000 Caraway ..... 166/84.3
6,129,152 A * 10/2000 Hosie et al. ..... 166/384

* cited by examiner

*Primary Examiner*—David Bagnell
*Assistant Examiner*—Shane Bomar

(57) ABSTRACT

An armored stripper rubber is provided that protects the drillstring bore of the stripper rubber from substrate infiltration, yet pivotally dilates to facilitate the passage of drillstring components through the bore while effectively maintaining a fluid-tight seal. Additionally, the stripper rubber substantially inhibits resilient contraction of the stripper rubber to an internal bore diameter smaller than a pre-selected internal diameter. The armored stripper rubber, or armadillo, substantially prevents rubber inversion and puckering under high operational well pressures. Also provided are stripper rubber inserts and insert assemblies.

8 Claims, 7 Drawing Sheets

ARMORED STRIPPER RUBBER

CROSS-REFERENCE TO RELATED APPLICATIONS

The present invention is a continuation-in-part of, and claims priority from, U.S. patent application Ser. No. 10/783450, filed Feb. 20, 2004, by the present inventor, and entitled Stripper Rubber Insert Assembly.

FIELD OF THE INVENTION

This invention relates to a long-lasting, deformation-resistant, rubber or elastomer-based seal having a configuration for dynamically sealing against tubular members or drillstring components movable longitudinally through the seal. In particular, the invention relates to stripper rubbers, inserts, and insert assemblies, for stripper rubbers used with rotating control heads, rotating blowout preventers, diverter/preventers and the like, in oil, gas, coal-bed methane, water or geothermal wells.

BACKGROUND OF THE INVENTION

In the drilling industry, seals are used in various applications including rotating blowout preventers, swab cups, pipe and Kelly wipers, sucker rod guides, tubing protectors, stuffing box rubbers, stripper rubbers for coiled tubing applications, snubbing stripper rubbers, and stripper rubbers for rotating control heads or diverter/preventers. Stripper rubbers, for example, are utilized in rotating control heads to seal around the rough and irregular outside diameter of a drillstring of a drilling rig.

Stripper rubbers are currently made so that the inside diameter of the stripper rubber is considerably smaller (usually about one inch) than the smallest outside diameter of any component of a drillstring. As the components move longitudinally through the interior of the stripper rubber, a seal is continuously affected.

Stripper rubbers affect self-actuating fluid-tight seals in that, as pressure builds in the annulus of a well, and in the bowl of the rotating control head, the vector forces of that pressure bear against the outside surface or profile of the stripper rubber and compress the stripper rubber against the outside surface of the drillstring. The pressure forces complement the stretch-fit forces already present in the stripper rubber. The result is an active mechanical seal the increases the seal strength as the well bore pressure increases.

Well pressure forces often distort the elastic profile of a stripper rubber, deforming the shape from that of a cone to that of a donut. Lowering an oil tool through the stripper rubber often causes the deformed, rolled up, rubber to temporarily uncurl, but the rubber quickly returns to the deformed donut shape once it is re-pressurized. Wear and tear on the stripper rubber occurs, therefore, not only from frictional forces between the rubber and a longitudinally moving oil tool, but from the mechanical forces acting on the rubber as it rolls up and unrolls during drilling operations.

Stripper rubbers seal around rough and irregular surfaces of varying diameters such as those found around a drill pipe, tool joints, or a Kelly, and are operated under drilling conditions where strength and resistance to wear are prized attributes. When using a stripper rubber in a rotating control head, the longitudinal location of the rotating control head is fixed due to the mounting of a stripper rubber onto a bearing assembly. The bearing assembly allows the stripper rubber, or stripper rubbers, to rotate with the Kelly or drillstring, but restrains the stripper rubber from longitudinal, axial, movement. Wear of the interior surface of a stripper rubber is caused by relative longitudinal movement of the drillstring components, including the end to end coupling areas of larger diameter joints and the larger diameter of tools that bear against a stripper rubber.

Wear and tear upon a stripper rubber from frictional and mechanical forces will, over a period of time, cause a thinning or weakening of the elastic material to the point that the stripper rubber will fail. Such wear is exacerbated by the movement of multiple lengths of a drillstring through the stripper rubber, such as when a drillstring is "tripped" into or out of the well. Furthermore, the stretch-fit of the rubber rapidly becomes exhausted, and the rubber fails to seal the well. Rapid exhaustion of the rubber remains a persistent problem, and requires frequent, sometimes as often as weekly, replacement of the stripper rubber.

Metal structures, called "inserts," embedded in the rubber portion of a stripper rubber are used to provide connectors and structural support to the rubber. For example, U.S. Pat. No. 5,647,444, issued to the present inventor, discloses a dual stripper rubber apparatus. Each stripper rubber provides a pair of circular spring inserts that circumnavigate the packer perpendicular to the drillstring bore. The springs provide structural support to the rubber, yet permit the rubber to dilate so that pipe joints or tools can pass through the drillstring bore of the stripper rubbers.

Wear is present in all drilling and production applications where a rubber seal or wiper is subjected to the relative movement of a component such as a drillstring tool. A long-felt need persists for a rubber seal or wiper that is resistant to wear, will withstand the great bore hole pressures of modern wells, and is capable of a longer service life than has been heretofore possible.

BRIEF DESCRIPTION OF THE DRAWINGS

The present invention is further described in the detailed description that follows, by reference to the noted drawings by way of non-limiting examples of embodiments of the present invention, in which like reference numerals represent similar ports throughout several views of the drawings, and in which.

DETAILED DESCRIPTION OF THE INVENTION

Figure 1A:
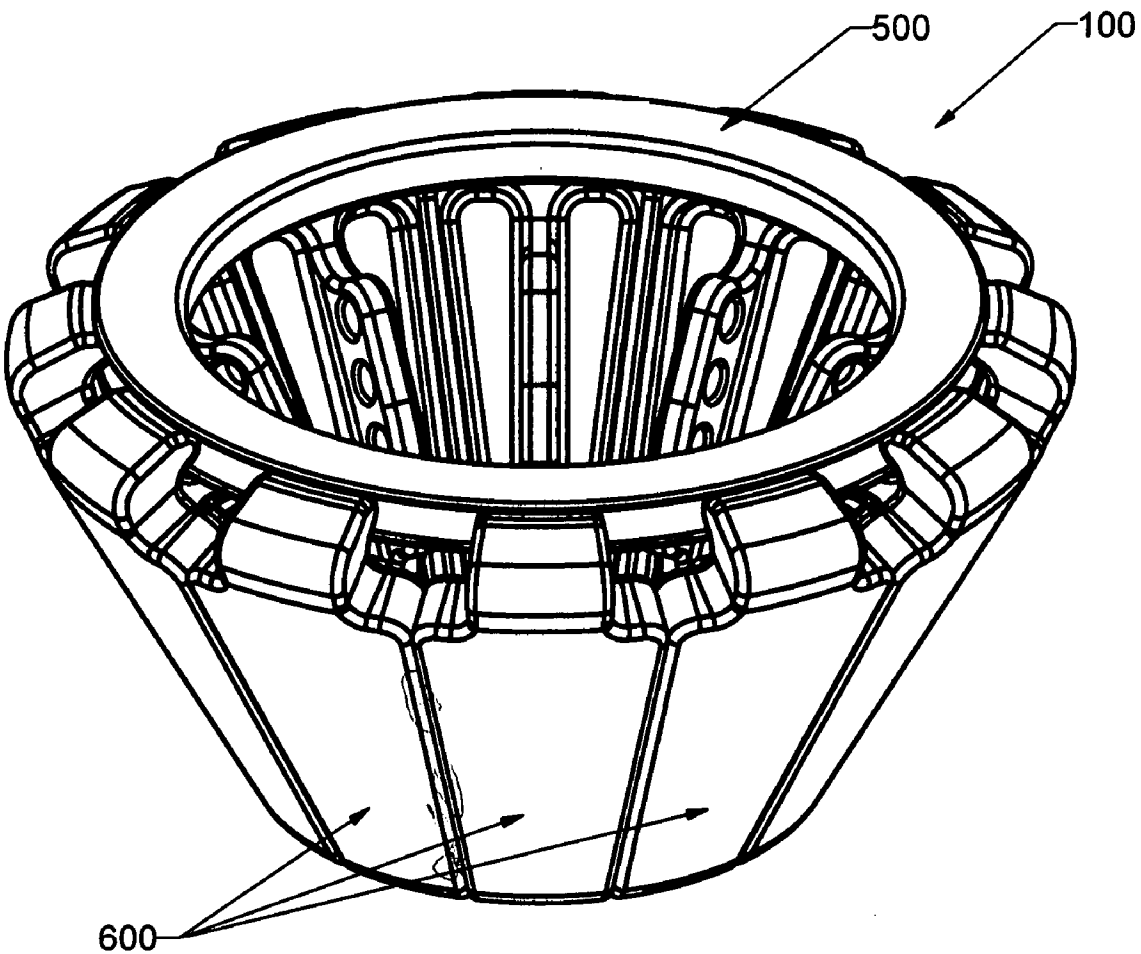
FIG. 1*a* is an isometric-view schematic drawing of an insert assembly of one embodiment of the present invention in a contracted posture.

In view of the foregoing, the present invention, through one or more of its various aspects, embodiments and/or specific features or sub-components, is thus intended to bring out one or more of the advantages that will be evident from the description. The present invention is described with frequent reference to stripper rubber inserts. It is understood that a stripper rubber insert is merely an example of a specific embodiment of the present invention, which is directed generically to resilient substrate inserts within the scope of the invention. The terminology, therefore, is not intended to limit the scope of the invention.

Long lasting stripper rubbers have been a long felt need in the drilling industry. The advantage of a longer lasting stripper rubber is not only one of safety, but also one of expense since a longer lasting stripper rubber will reduce the number of occasions when the stripper rubber must be replaced, an expensive and time consuming undertaking. A further consideration is the tremendous borehole pressures encountered in modern drilling. Technology enables under balanced drilling. A challenge of modern drilling is to control the great and variable pressures of high-pressure reserves.

The present invention provides stripper rubbers, inserts, and stripper rubber-insert assemblies that substantially preserve the profile of the rubber under pressure. An advantage of preserving the rubber profile under pressure is that deformation of the rubber caused by the bore pressure of the well is significantly inhibited from blocking the passage of a tool or drillstring joint through the drillstring bore of the stripper rubber.

Another advantage of the present invention is that tools or drillstring joints are tripped up or down hole while the stripper rubber maintains a fluid-tight seal around the drillstring under the pressures of modern wells. The present invention permits the stripper rubber to dilate so that drillstring and tool joints can be tripped through the bore, and then contract around smaller diameter drilling tube with a fluid-tight seal.

Generally, stripper rubbers have a frusto-conical shape, being internally wider at the top than at the bottom. The interior shape facilitates passing a joint or tool downhole through the drillstring bore of the stripper rubber by providing a wide top opening to accommodate the tool joint, and tapering downward to a narrower interior opening at the bottom so that the rubber maintains a fluid-tight seal around the drillstring as the tool joint passes through. The resilient nature of the rubber permits the tapered portion of the stripper rubber to dilate so that the tool can pass through.

In the absence of external pressure, an annular void exists between the exterior surface of the drillstring and interior surface of the tapered rubber, approximately where the tapering begins at the top of the rubber and extending downward to where the rubber seals around the drillstring. The void exists because the exterior surface of the drillstring has a substantially uniform outer diameter whereas the interior surface of the stripper rubber tapers downward from wider to narrower. The tapered interior shape of the striper rubber facilitates "stabbing" a tool joint through the drillstring bore of the stripper rubber, where the diameter of the tool joint is wider than the lower (narrow) portion of the interior of the stripper rubber drillstring bore.

In operation, upward and inward bore pressures from the well deform typical stripper rubbers and push rubber into the void, filling the void with pressurized rubber. It becomes difficult, therefore, to trip drillstring joints or tools through the stripper rubber. The advantages of the tapered shape of the stripper rubber are lost when the rubber is under pressure.

The present invention provides an armored stripper rubber with pivoting inserts that form a dynamic, dilatable and contractible external shell around the rubber. The shell is somewhat analogous to the shell of an armadillo or pill bug. The inserts act in concert to substantially maintain the profile of the rubber under pressure to significantly inhibit pressurized rubber from infiltrating into the void. An advantage of the present invention, therefore, is that tool or drillstring joints may pass through the stripper rubber without encountering a blockage of pressurized rubber filling the void. A further advantage of the present invention is that it increases the capability of the stripper rubber to provide an effective seal around the drillstring and drillstring components. That is, an effective seal is maintained at pressures that would cause prior art stripper rubbers to fail.

Referring to the drawings, FIG. 1A is an isometric-view schematic drawing of an insert assembly of one embodiment of the present invention in a contracted posture. Assembly 100 is depicted without the elastic sealing material, or other resilient substrate, in which the various inserts are at least partially embedded, in order to view the "cage" formed by the assembly of inserts provided by the present invention.

In broad strokes, assembly 100 includes support ring 500 and a plurality of insert "fingers" 600 pendant therefrom. Fingers 600 taper downward from support ring 500 and fit together to form a frusto-conical exterior shape. To provide dynamic resiliency, fingers 600 pivot from support ring 500 such that the narrow, bottom, portion of assembly 100 can dilate and contract, depending on the external diameter of the structure (not shown) disposed or passing through assembly 100.

It is evident from the drawing that shell formed by the inserts in the contracted posture substantially prevents a stripper rubber from contracting to an internal bore diameter smaller than a pre-selected diameter, because the "plates" of the shell fit together and effectively stop further contraction, even under high pressure. Accordingly, the present invention effectively inhibits infiltration, such as puckering or inversion of the resilient substrate, into the drillstring bore of the stripper rubber, which typically occurs with prior art rubbers when they are exposed to downhole well pressures.

Figure 1B:
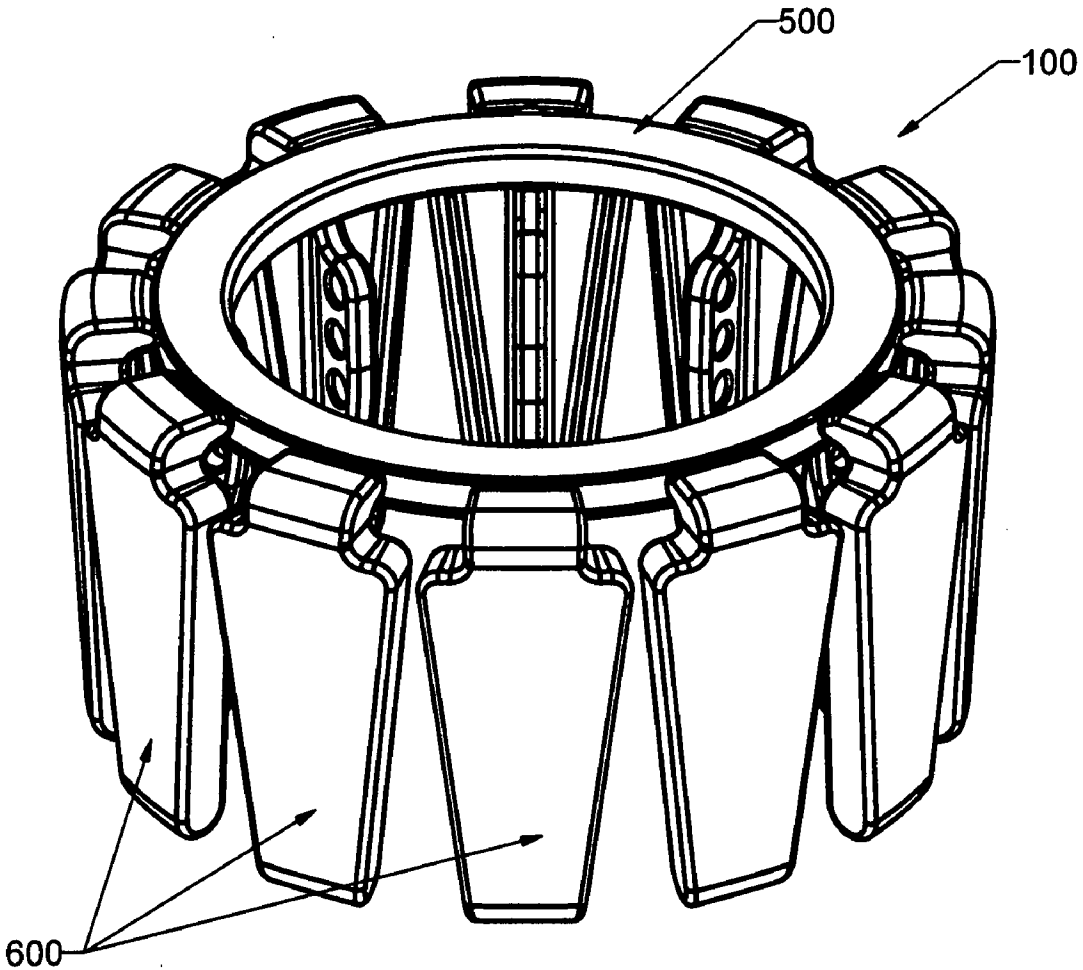
FIG. 1B is an isometric-view schematic drawing of the insert assembly of FIG. 1A in a dilated posture.

FIG. 1B is an isometric-view schematic drawing of insert assembly 100 of FIG. 1A in a dilated posture. Insert fingers, or plates, 600 resiliently and elastically pivot radially inward and outward from support ring 500 to facilitate the passage of drillstring components through the drillstring bore of the stripper rubber while maintaining an effective fluid-tight seal around the drillstring.

Stripper rubbers having a connector insert that provides means for connecting the stripper rubber to an adapter, inner barrel, or other piece of drilling head equipment, are known in the art. To attach a stripper rubber of the present invention to an inner barrel or other piece of drilling head equipment, therefore, support ring 500 is connected to a connector insert (not shown). For example, support ring 500 may be spot welded, bolted, formed with, or otherwise adapted to a connector insert.

In alternative embodiments, however, support ring 500, indeed, assembly 100, is not attached directly to a connector insert, and relies, instead, on the mechanical bonding forces of the cured rubber (or other resilient substrate) of the stripper rubber to maintain an attachment to a connector insert.

Figure 2B:
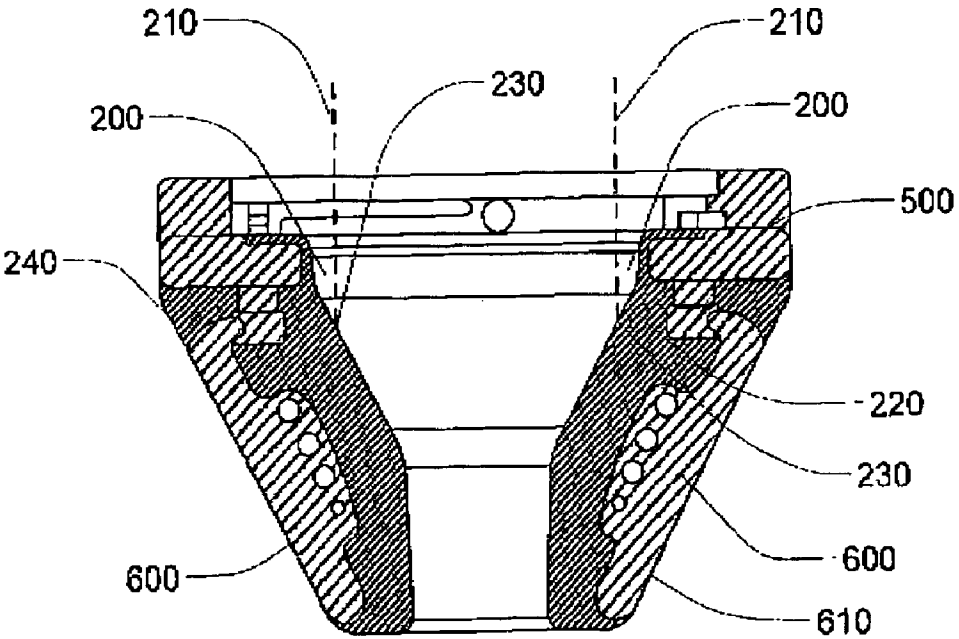
FIG. 2B is a side view vertical cross-section of the insert assembly of FIG. 2A through line 1—1.
Figure 2A:
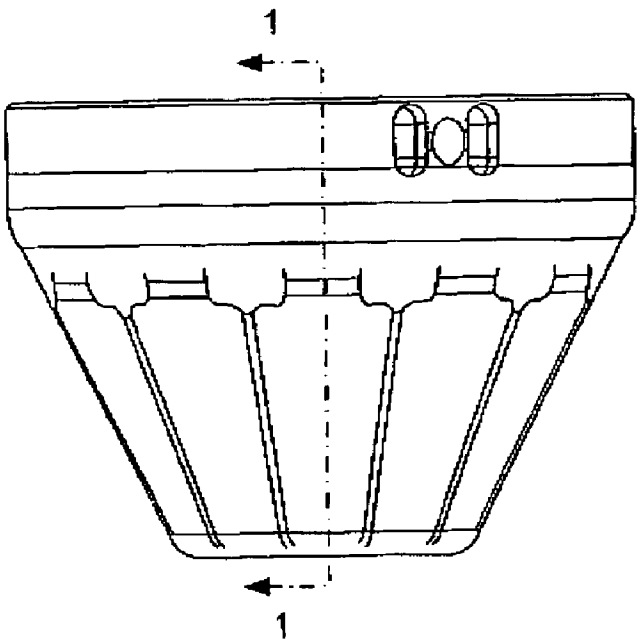
FIG. 2A is a side view of on insert assembly of FIG. 1A.

FIG. 2A is a side view of an insert assembly of FIG. 1A. FIG. 2B is a side view vertical cross-section of the insert assembly of FIG. 2A through line 1—1. In the absence of well pressure, void 200 exists between exterior surface 210 of the drillstring indicated by a vertical dashed line, and interior surface 220 of the stripper rubber. Annular seal point 230 where tapered interior surface 220 of the stripper rubber contacts drillstring surface 210, defines the lower perimeter of void 200.

Although the rubber substrate of a stripper rubber is resilient or elastic to a certain extent, the substrate is, nevertheless, a cured polymer that generally requires substantial force to elastically deform. Under the well pressures of typical wells, and certainly under the high pressures of particular wells, the rubber substrate of a typical prior art stripper rubber would be forced upward, deforming the profile of the rubber such that the rubber at least partially fills void 200. Catastrophic deformation is known to occur, where the stripper rubber deforms into void 200 to such an extreme, or with such force, as to "blowout" the rubber. "Blowout" is a misnomer, in that the rubber actually implodes inward, perforates, and pressurized fluids burst upward to blast out into the atmosphere.

The present invention, however, substantially overcomes the problem of blowouts. In the embodiment of FIG. 2, for example, finger inserts 600 provide structural support to the rubber substrate of the stripper rubber to substantially preserve its profile and inhibit the infiltration of void 200 by pressurized rubber. The insert cage around the exterior of the rubber and the drillstring through the stripper rubber drillstring bore, combine to confine the rubber such that, effectively, the rubber becomes less elastic. One advantage of the loss of elasticity is that the fluid-tight seal can be maintained at high pressures. Another advantage of the loss of elasticity is that blowouts are substantially reduced.

Exterior surface 610 of each finger 600 extends outward at least slightly beyond flush with exterior surface 240 of the rubber portion of the stripper rubber. When in a contracted posture, such as when pressurized, finger inserts 600 substantially encase the rubber substrate in a shell of rigid material, such as metal, which withstands the well pressure without substantial deformation. Accordingly, joints can be tripped through the stripper rubber without encountering a significant blockage of confined pressurized rubber.

Since fingers 600 are pivotally suspended from ring 500, an additional benefit of the present invention is that the stripper rubber of the present invention is able to dilate, while maintaining a fluid-tight seal, to allow joints to trip through without compromising the seal, and then to contract around the drillstring to preserve the fluid-tight seal after the joint has passed. Alternative embodiments further provide one or more circumference spring inserts (not shown) axially positioned in the substrate to provide additional structural support or to reinforce the fluid-tight seal.

Support ring 500 is entirely embedded in the rubber substrate. The attachment of fingers 600 to support ring 500, therefore, is reinforced by the rubber.

Figure 3:
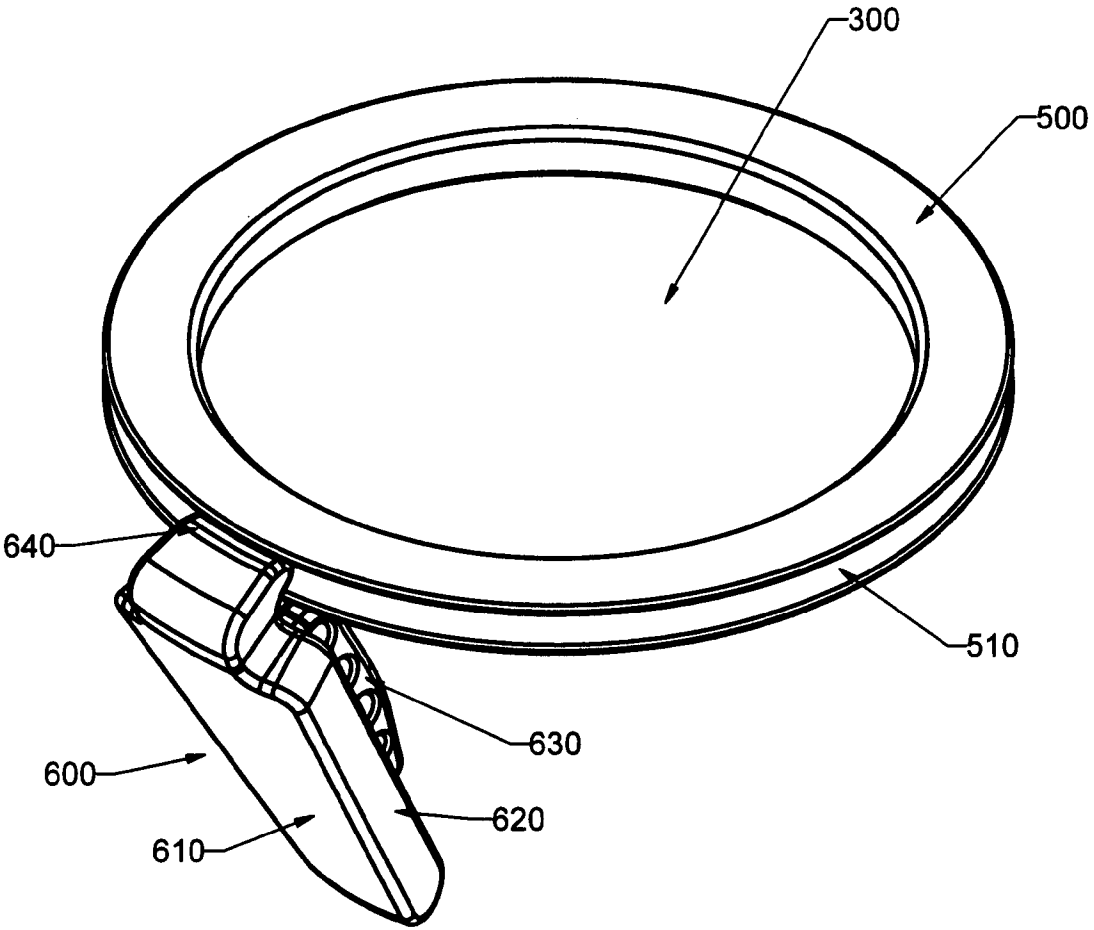
FIG. 3 is an isometric-view schematic drawing of a support ring with a single unit of insert armor (finger) pendant therefrom.

FIG. 3 is an isometric-view schematic drawing of support ring 500 with a single unit, or "finger," of insert armor 600 pivotally pendant therefrom. Ring 500 defines drillstring bore 300, through which lengths of drillstring, together with attendant joints or tools, are tripped up or down well.

Support ring groove 510 traverses the circumference of ring 500 perpendicular to drillstring bore 300. Insert finger 600 is oriented such that surface 610 is an exterior surface and surface 620 is a side surface. The side opposite surface 610, i.e., the interior surface of finger 600, provides insert flange 630, which extends inward toward bore 300. Hinge portion 640 and groove 510 are cooperatively adapted to provide a pivoting attachment. Particular embodiments of the invention allow for insert finger 600 to "snap" on to support ring 500 at groove 510 to accomplish the pivoting attachment. Other embodiments (not shown) provide a pin and bore type hinge.

Figure 4:
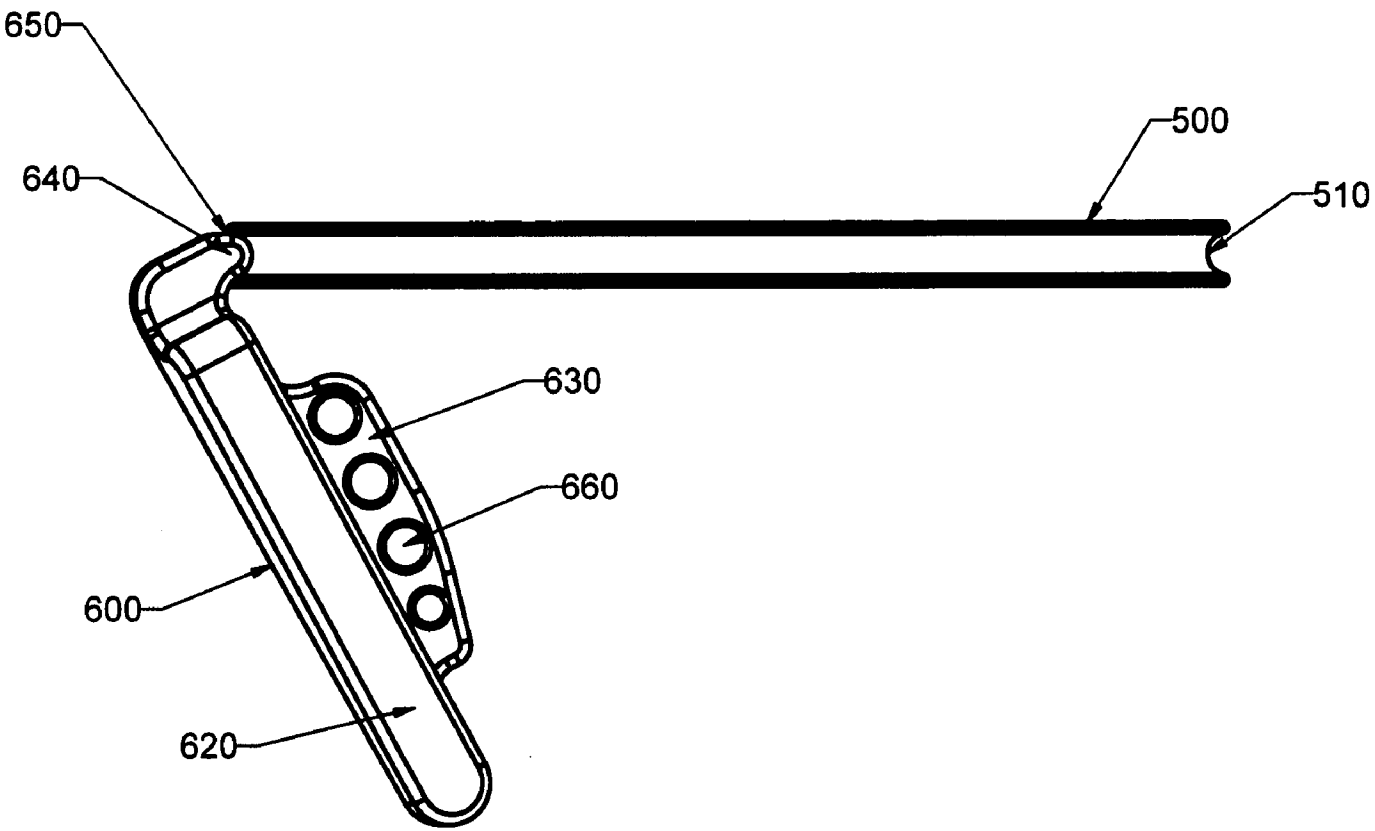
FIG. 4 is a side-view schematic drawing of the support ring-finger assembly of FIG. 3.

FIG. 4 is a side-view schematic drawing of the support ring-finger assembly of FIG. 3. Hinge portion 640 of insert 600 provides a convex extension, or lip, 650 (male) that mates with concave groove 510 (female) of support ring 500. Alternative embodiments (not shown) of the invention provide an inverse relationship, wherein support ring 500 has a male, or convex, circumference 510, and hinge portion 640 has a female, or concave portion 650, that mate together to form a pivoting attachment.

Insert flange 630 is recommended to provide one or more flange bores 660. Bores, or perforations, 660 become infiltrated with fluid rubber, or other suitable elastomer material, during manufacture of the stripper rubber. Once the rubber is cured, bores 660 enhance the physical, mechanical, bond of insert 600 to the rubber substrate.

Figure 5:
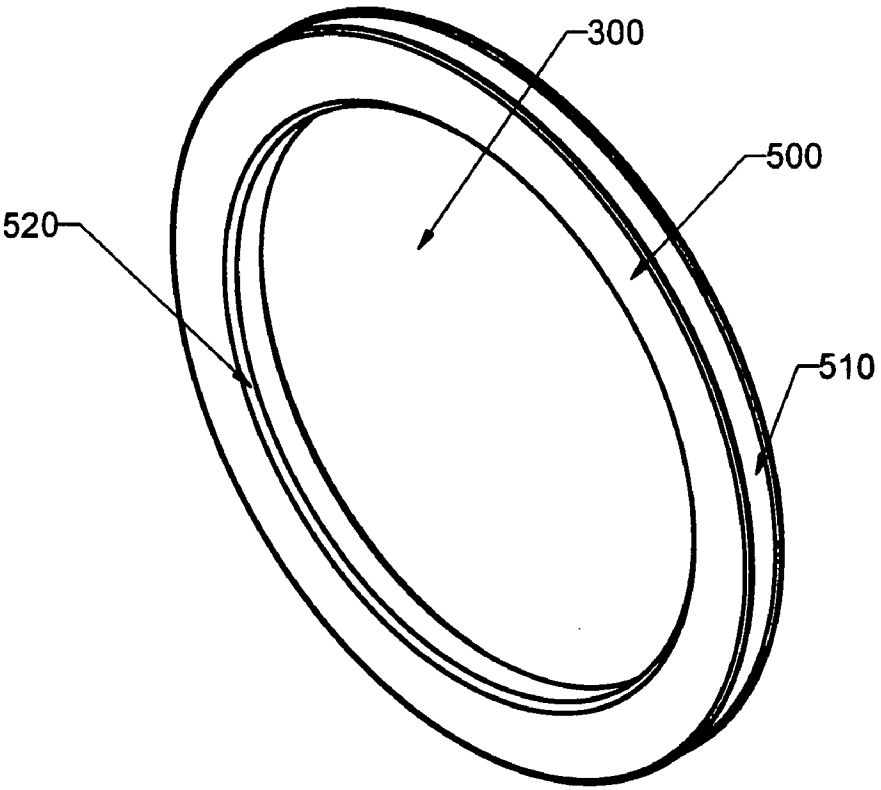
FIG. 5 is an isometric-view schematic drawing of a support ring of one embodiment of the present invention.

FIG. 5 is an isometric-view schematic drawing of support ring 500 of one embodiment of the present invention. The inner diameter of drillstring bore 300 should be sized to accommodate the largest joint or tool to be tripped through the stripper rubber. Accordingly, the present invention contemplates embodiments of varying diameters as defined by the diameter of bore 300.

Support ring 500 is on insert that is entirely embedded in the rubber substrate of the stripper rubber. It is recommended that the exterior surface of ring 500 be as devoid as practicable of sharp edges or acute angles so as to minimize the ability of the ring to cut or shred the rubber as the result of shearing actions from elastic deformation. Chamfer 520, for example, bevels on interior circumference edge of ring 500 to reduce the sharpness of the edge.

Figure 6:
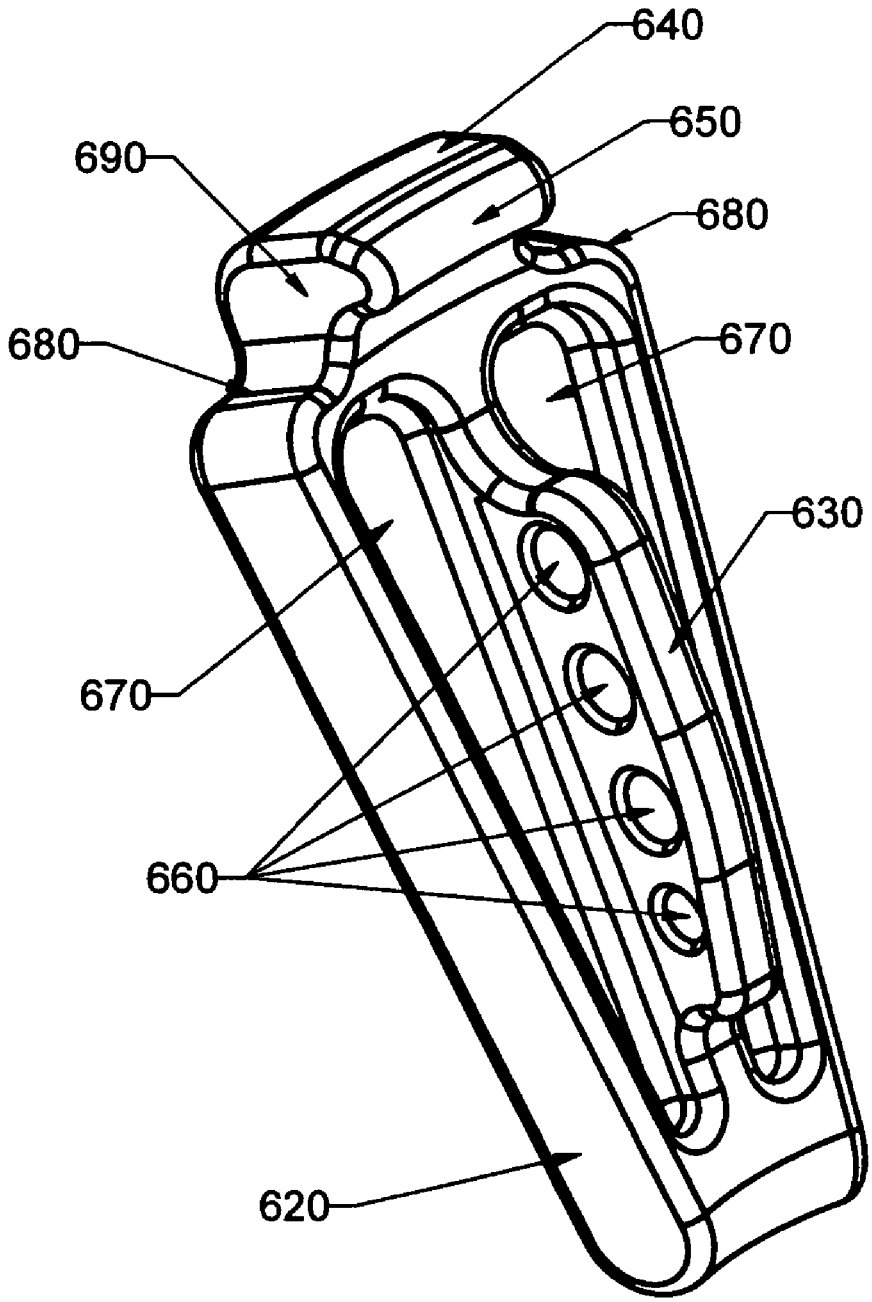
FIG. 6 is on isometric-view schematic drawing of a finger insert of one embodiment of the present invention.

FIG. 6 is an isometric-view schematic drawing of finger armor insert 600 of one embodiment of the present invention. The view features the interior side of insert 600. Inserts are typically made of metal or metal alloys, but the present invention further contemplates that inserts may be synthetic, composite or any suitably durable material. Forming a strong bond between the insert and the rubber substrate is an engineering challenge recognized in the art. One strategy is to provide perforated inserts.

During production of the present invention, for example, fluid elastic material such as rubber, or any suitably resilient substrate, fills flange bores 660 so that, upon resilient hardening or curing of the substrate, finger 600 becomes mechanically embedded, except for exterior surface 610, in the material and thus becomes an insert. In effect, flange 630 is gripped by the cured rubber through perforations 660 so that it is very difficult for insert 600 to slip out of the rubber. Beveled edges for perforations 660 reduce shear that would tend to cut the rubber.

While recommended, perforations 660 are not required. The particular number, shape, size, orientation, or other parameters of the perforations may be selected as desired or as recommended by experience. Alternative embodiments of the present invention, for example, provide perforations (not shown) through recesses 670 which extend out through exterior surface 610. Particular embodiments of such perforations through recesses 670 provide a relatively small diameter bore proximate to recesses 670 opening to a relatively larger diameter bore proximate to surface 610. Other means for enhancing the mechanical grip of the rubber on the insert include dimples (concave recesses), bumps (convex extensions), or any topological feature, or combinations thereof, that the rubber can grip.

To further enhance the strength of the insertion, one or more recesses 670 are filled with a bonding agent that provides, or improves, the chemical bond between the insert and the cured rubber. The combination of chemical bonding with mechanical gripping provides a highly reliable stripper rubber insert assembly.

Each finger insert 600 tapers downward at an angle compatible with the tapering of the stripper rubber. Side surface 620, on each longitudinal side of insert 600, is angled inward. When the insert "cage" of the depicted embodiment is assembled, with a plurality of finger inserts 600 pivotally suspended from a support ring, and the assembly is in a contracted posture, the inward angle of each side surface 620 is adapted so that fingers 600 substantially fit together to provide a shell of armor around the rubber substrate. See FIG. 1. In an embodiment having 12 finger inserts forming the cage, for example, each side surface 620 angles inward at 30°. The inward angle is adapted to provide a selected fit of the fingers, depending on the number of fingers provided in a selected embodiment of the invention. A significant feature of the cage of the present invention is that the cage stops further significant contraction of the stripper rubber once the plurality of fingers 600 are compressed together.

Operationally, a stripper rubber contracts under the pressure of a well. In fact, it is not uncommon for the rubber to invert or pucker under high pressure, thus compromising the seal and/or causing drillstring pipe to become stuck within the rubber. Inadequate structural support to stop the contraction and maintain the rubber profile is a prime contributing factor to such problems.

An advantage of the present invention is that, by virtue of fitting together to form a shell when the stripper rubber is exposed to operational well pressures, finger inserts 600 physically contact each other along sides 620 and stop the shell from contracting any smaller than a specific diameter. The shell substantially prevents inversion or puckering of the rubber and, thus, substantially reduces incidents of undesirable results from rubber deformation.

Particular embodiments of the present invention provide finger inserts 600 that extend substantially the entire longitudinal length of the stripper. Other embodiments provide inserts 600 that are some selected length shorter than the stripper rubber, so that a desired length of rubber extends beyond the bottom of the shell. A specific embodiment may be selected depending on the nature of the performance that is desired by the well operator. A longer insert provides greater structural support to reduce rubber deformation, whereas a shorter insert may provide a better fluid-tight seal.

The finger insert embodiment depicted in FIG. 6 is formed to provide a finger shoulder 680 proximate to, and to either side of, hinge portion 640. Alternative embodiments substantially eliminate finger shoulders 680, so that hinge sides 690 are substantially contiguous with insert sides 620.

Further advantages of the present invention include a stripper rubber that maintains its profile, that is, resists longitudinal elastic deformation from bore pressures acting on the resilient substrate. Another advantage of the present invention is a stripper rubber that withstands the high, sometimes explosive, bore hole pressures encountered in certain wells. By providing a stripper rubber that withstands high pressure, the present invention enables effective pressure control for high pressure wells.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses, either now known or which become known, such as are within the scope of the appended claims.

I claim:

1. An insert for a stripper rubber, wherein the stripper rubber has a resilient sealing portion having a vertical length, the insert comprising:

a non-ball hinge portion;

an exterior side descending from the hinge portion for substantially the vertical length of the resilient sealing portion of the stripper rubber;

an interior side opposite the exterior side;

a flange extending from the interior side;

opposed longitudinal sides between the exterior and interior sides and inclined toward the flange at a selected angle; and a lateral cross-section, wherein the lateral cross-section of the insert tapers away from the hinge portion.

2. An assembly of stripper rubber inserts, the assembly comprising:

a support ring insert having a continuous circumference groove adapted to pivotally suspend a plurality of insert fingers; and a plurality of insert fingers pivotally suspended from the support ring, wherein each insert finger further comprises a non-ball hinge portion; an exterior side descending from the hinge portion; an interior side opposite the exterior side; a flange extending from the inferior side; opposed longitudinal sides between the exterior and interior sides and inclined toward the flange at a selected angle; and a lateral cross-section, wherein the lateral cross-section of the insert tapers away from the hinge portion.

3. The assembly of claim 2, further comprising the stripper rubber; the support ring being embedded in the stripper rubber.

4. The assembly of claim 3, wherein the stripper rubber defines an interior, at least partially frusto-conical, drillstring bore and provides an effective resilient seal around drillstring components in the bore; and further wherein each insert finger comprises a side exterior to the stripper rubber such that the plurality is compressible into a substantially continuous exterior shell around the stripper rubber to protect the drillstring bore from significant interior and exterior deformation of the resilient seal yet pivotally dilates to facilitate the passage of drillstring components through the drillstring bore while effectively maintaining the seal.

5. A stripper rubber comprising:

a resilient substrate having a vertical length and defining an at least partially frusto-conical drillstring bore, wherein the substrate provides an effective resilient seal around drillstring components in the bore;

a support ring insert in the substrate and having a continuous circumference groove adapted to pivotally suspend a plurality of insert fingers; and a plurality of insert fingers, each finger pivotally suspended from the support ring by a non-ball hinge, wherein each finger comprises a side exterior to the substrate and extends for substantially the vertical length of the substrate such that the plurality of fingers is compressible into a substantially continuous exterior shell around the substrate to protect the drillstring bore from significant substrate infiltration yet pivotally dilates to facilitate the passage of drillstring components Through the drillstring bore while effectively maintaining the seal.

6. The stripper rubber of claim 5, wherein the insert finger shell substantially inhibits resilient contraction of the stripper rubber to an internal bore diameter significantly smaller than a pre-selected internal diameter.

7. A stripper rubber comprising:

a resilient substrate having a vertical length and defining an at least partially frusto-conical drillstring bore, wherein the substrate provides an effective resilient seal around drillstring components in the bore:

a support ring insert in the substrate: the support ring further comprising a circumference exterior groove to pivotally receive a hinge portion of an insert finger; and a plurality of insert fingers pivotally suspended from the support ring, wherein each finger further comprises;

a non-ball hinge portion, each insert finger being pivotally suspended from the support ring by pivotal retention of the hinge portion of the finger by the groove of the support ring; and a side exterior to the substrate and extending for substantially the vertical length of the resilient substrate such that the plurality is compressible into a substantially continuous exterior shell around the substrate to protect the drillstring bore from significant substrate infiltration yet pivotally dilates to facilitate the passage of drillstring components through the drillstring bore while effectively maintaining the seal.

8. The stripper rubber of claim 7, wherein the insert finger shell substantially inhibits resilient contraction of the stripper rubber to an internal bore diameter smaller than a pre-selected internal diameter.

* * * * *